US005141616A

United States Patent [19]

Heinke

[11] Patent Number: 5,141,616

[45] Date of Patent: Aug. 25, 1992

[54] ELECTRODE FOR EXTRACTING METALS FROM A METAL ION SOLUTION

[75] Inventor: Harri Heinke, Erlensee, Fed. Rep. of Germany

[73] Assignee: Heraeus Elektroden GmbH, Hanau

[21] Appl. No.: 734,573

[22] Filed: Jul. 23, 1991

[51] Int. Cl.[5] ..... C25C 7/00

[52] U.S. Cl. ..... 204/208

[58] Field of Search ..... 204/208

[56] References Cited

U.S. PATENT DOCUMENTS

| | | | |
|---|---|---|---|
| 2,099,873 | 11/1937 | Sternfels | 204/216 |
| 2,748,071 | 5/1956 | Eisler | 204/208 |
| 2,964,453 | 12/1960 | Garn | 204/208 |
| 2,985,568 | 5/1961 | Ziegler | 204/208 |

FOREIGN PATENT DOCUMENTS

| | | |
|---|---|---|
| 513509 | 3/1953 | Belgium . |
| 9003456 | 4/1990 | PCT Int'l Appl. . |

OTHER PUBLICATIONS

Chemical Abstracts, Band 90, No. 14.2 Apr. 1979 p. 543.

*Primary Examiner*—T. M. Tufariello

*Attorney, Agent, or Firm*—Felfe & Lynch

[57] ABSTRACT

Cathode includes a drum at least partly immersed in a metal ion solution and a flexible metallic band passing around the drum and driven by a drive roller outside the solution, both the cathode drum and the drive roller having axes which form an angle with a surface normal of the solution ranging between 20 and 70 degrees.

10 Claims, 4 Drawing Sheets

ELECTRODE FOR EXTRACTING METALS FROM A METAL ION SOLUTION

BACKGROUND OF THE INVENTION

The invention relates to an apparatus for the continuous electrolytic extraction of metals from a metal ion solution in which an anode and a cathode, both electrically connected to a power supply, are immersed. The cathode has a surface configured as a continuous flexible band partly immersed in the solution and passing through it. The deposited metal is removed from this surface outside the solution. The flexible band is metallic at least on the one part of its surface on which the metal is deposited. A scraper for the removal of the deposited metal is disposed outside the solution, and the band is guided by means of guiding and driving rollers.

U.S. Pat. No. 4,786,384 discloses an electrolytic cell for the electrolytic extraction of metals from a liquid containing metal ions, particularly process waste water. In a trough, this cell contains a multiple of planar electrodes spaced apart in parallel. The cathodes have openings and are connected to the power source via differently sized connecting resistors, depending on the distance to the anode, such that the same current density is supplied to each cathode.

The problems involved in the operation of such an apparatus include the individual withdrawal of the cathode surface bearing the deposited metal, which involves excessive labor costs and the relatively labor-energy-intensive removal of the deposited material.

U.S. Pat. No. 4,647,345 discloses an electrolytic apparatus for the continuous manufacture of metal foils from a solution which contains metal ions and is stored in a tank. The cathode which is partly immersed in the solution is configured as a drum or a continuously moving band. In the immersed area, it is surrounded by a spaced apart anode which is provided with channels and openings for the supply of electrolyte. After the withdrawal from the solution, the metal, which is deposited on the cathode, is separated from the cathode.

The cathode has a surface consisting of metal, for example, titanium or tantalum, whereas the anode is made of titanium, for example. The solution used is an acidic metal ion solution, for example, copper sulfate or sulfuric acid.

One problem is the continuous extraction of metals by means of a movable cathode unless it is possible to deposit homogeneous compact self-supporting metal layers on the cathode. This is particularly difficult in case of slurry-like metal structures or dendrites or other non defined metal structures, like spherical structures which do not form homogeneous layers among each other during precipitation.

Further, U.S. Pat. No. 2,099,873 discloses an apparatus for extracting flocculent material from an electrolytic bath where the cathode is also a moving, continuous flexible band. The metal (chromium) is cathodically deposited on the band and from the electrolytic solution, it is supplied to separate a rinsing device where the deposited metal (chromium) is separated from the band. The band is guided by means of guiding and driving rollers. One driving roller guiding the band is rotated with its axis horizontally disposed above the bath. Only a minor portion of the surface area of the roller, which is large in comparison to the tank, immerses in the bath. A plurality of guiding rollers is provided outside the bath.

U.S. Pat. No. 2,748,071 discloses an apparatus for the regeneration of iron chloride in a copper etching process where a cathode surface which is also configured as a continuous band is guided via guiding and driving rollers. After emerging from the solution, the band is fed to a water bath in order to separate the copper. The scraper is a surgical knife, and the metal (copper) is supplied to another electrolytic tank. A removal of dried, powderized metal is not intended.

U.S. Pat. No. 2,964,453 also describes a regeneration process for a copper etching bath where a flexible band (platinum) is used which successively passes an etching bath, a rinsing bath and scraping bath. In the etching bath, the band operates cathodically and in the scraping bath anodically. The publication does not mention a mechanical scraping device as required in the practice to continue the processing of dried deposited material.

U.S. Pat. No. 2,985,568 discloses an electrolytic process for producing organometallic compounds which also features a metallic continuous band. A problem in this apparatus is the sealing of the hub of the cathode drum and the power supply to the cathode drum inside the electrolyte. Outside the bath, the continuous band passes a station with a mechanical scraper in the form of a knife.

SUMMARY OF THE INVENTION

The invention addresses the task of extracting precipitating metals from a metal ion solution in an inhomogeneous form. The object is to provide a largely automatic apparatus so that labor-cost-intensive operating steps for the removal of the deposited material no longer occur. Further, the purpose is to avoid sealing problems of the shaft and the hubs of the cathode drum. The power supply to the cathode drum must be outside the electrolyte.

The object is accomplished in that the axes of the guiding and driving rollers together with the surface normal to the level of the solution enclose an angle ranging between 20° and 70°. A first roller serving as a cathode drum immerses with its lower hub and at least a part of its electrically conductive surface area in the solution, and at least a second roller serving as guiding roller is disposed outside the solution. The band, on its surface facing the first roller, is electrically conductive.

An essential advantage of the invention is the fact that, on the one hand, a comparatively large area of the surface of the cathode drum and the part of the band enclosing the cathode drum immerse in the solution. On the other hand, there are no sealing problems with the bearings of the lower hub in the solution or trough. In a preferred embodiment of the invention, a rinsing device is provided downstream of the scraper so that the band is thoroughly cleaned before it re-enters the solution.

Further, the hub or shaft end of the first roller, which serves as a cathode drum, is connected to a current collector for the purpose of contacting the negative pole of the power source. It is thus possible to advantageously immerse practically the entire surface area and hence the area of the flexible band surrounding this surface area in the solution. On the other hand, this contact prevents corrosion problems in the power transmission to the cathode drum and ensuing increased transition resistance.

In a particularly advantageous embodiment, the cathode drum is supported only on one side, its top end; i.e. only the hub of the first roller or the shaft end protruding from the solution is used for support.

An essential advantage of this embodiment is the fact that there are practically no corrosion problems in the area of the drum bearing of the roller; moreover, due to this one-side support the cathode drum can be a readily replaced.

In another preferred embodiment, the band, after emerging from the solution and before reaching the scraper, is fed to a drier with coiled heaters emitting thermal radiation. Underneath the scraper, there is a collector for the deposited electrolyte-containing metal followed by a separating device.

Another essential advantage of the invention is the simple optimization by adjusting band speed and current density such that each of these parameters optimally matches the concentration and temperature of the respective solution. An additional advantage is the automation of the continuous deposition.

DETAILED DESCRIPTION OF THE PREFERRED EMBODIMENTS

Figure 1:
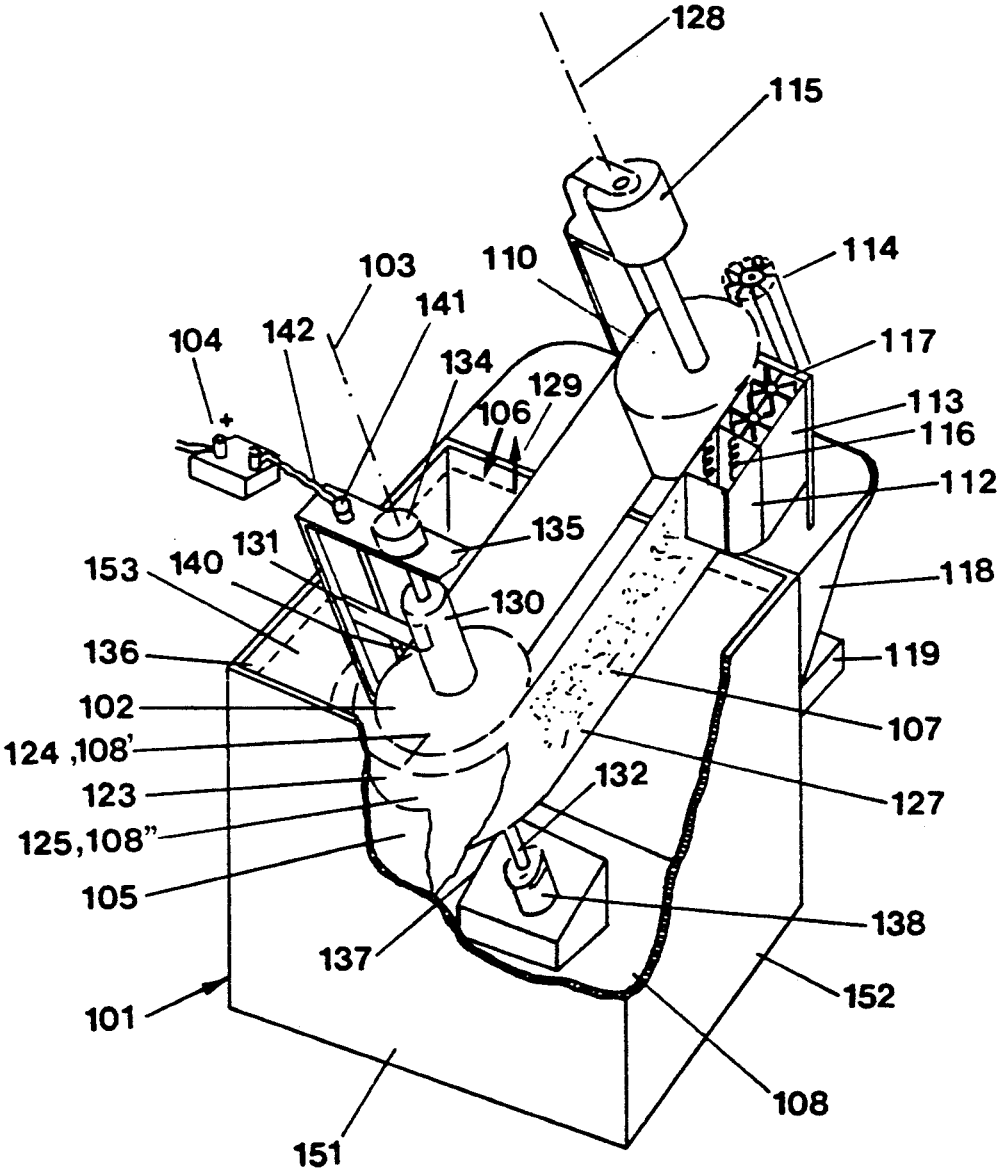
FIG. 1 is a perspective view of the apparatus.

In accordance with FIG. 1, the apparatus of the invention has a trough 101 that is made of an electrolyte-resistant material, for example a plastic, and contains solution 108. In the trough there is a first roller 102 which serves as a cathode drum and is electrically connected to the negative pole of a power source 104. This cathode drum 102 is rotatably supported at an axis 103 which encloses an angle $\alpha$ of approximately 45° together with the surface normal 129 extending over the level of the solution. On the side facing the front wall 151 and the lateral walls 152, 153, the cathode drum 102 is surrounded by a semi-circular or U-like anode 105 made of expanded metal or perforated metal with an activating layer connected to the positive pole of the power source 104. Anode 105, for the purpose of a better view is shown in a cut-away perspective. The connection to the power supply is omitted.

Figure 3:
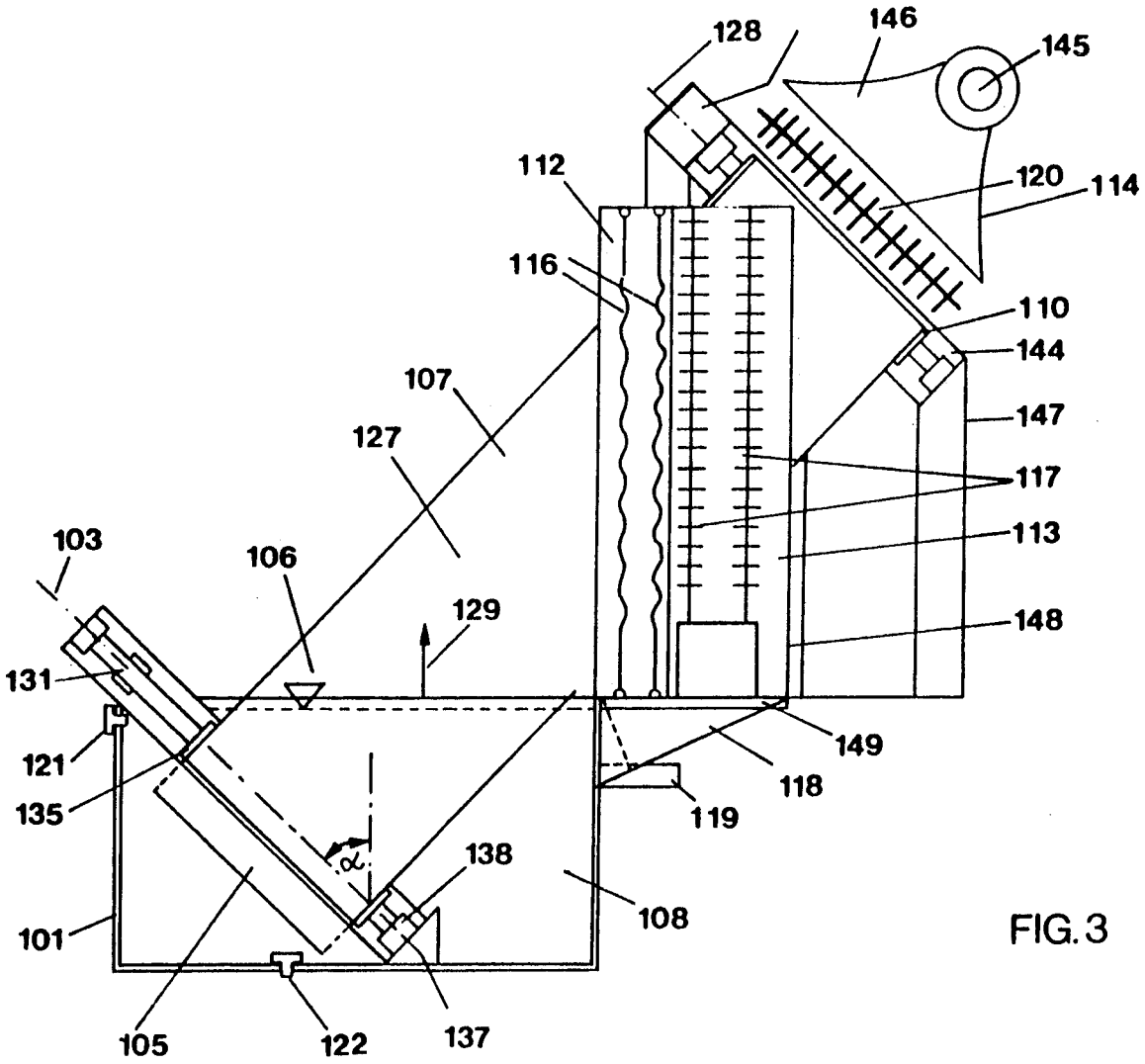
FIG. 3 is a longitudinal section through the apparatus.

The liquid level of solution 108 bears reference numeral 106 (FIG. 3). The flexible band 107 with its two metallic surfaces passing around the cathode drum is on the same potential as the cathode drum 102, i.e. the upper hub 130 of the cathode drum and the current collector 131 connect it to the negative pole of the power supply.

Support 135 has a current collector 131 above the liquid level of electrolyte 108 which, by means of collector ring contacts 139, is electrically connected to the electrically conductive upper hub 130 of the first roller 102. The collector 131 is connected to the power supply 104 via line 140 and contact 141 as well as line 142.

At its end, the upper hub 130 is held by a bearing 134 which is mounted to a holder 135 shown only partially and in a cut-away perspective. The latter in turn is connected to the pedestal 137 for bearing 138 by means of longitudinal column 136. Not represented connecting elements firmly join pedestal 137 and holder 135 to trough 101.

Lower hub 132 rests in the lower bearing 138 which due to a wedge-like pedestal support 137 forms an a 45° angle with respect to the normal line 129 of the liquid level 108.

Figure 4:
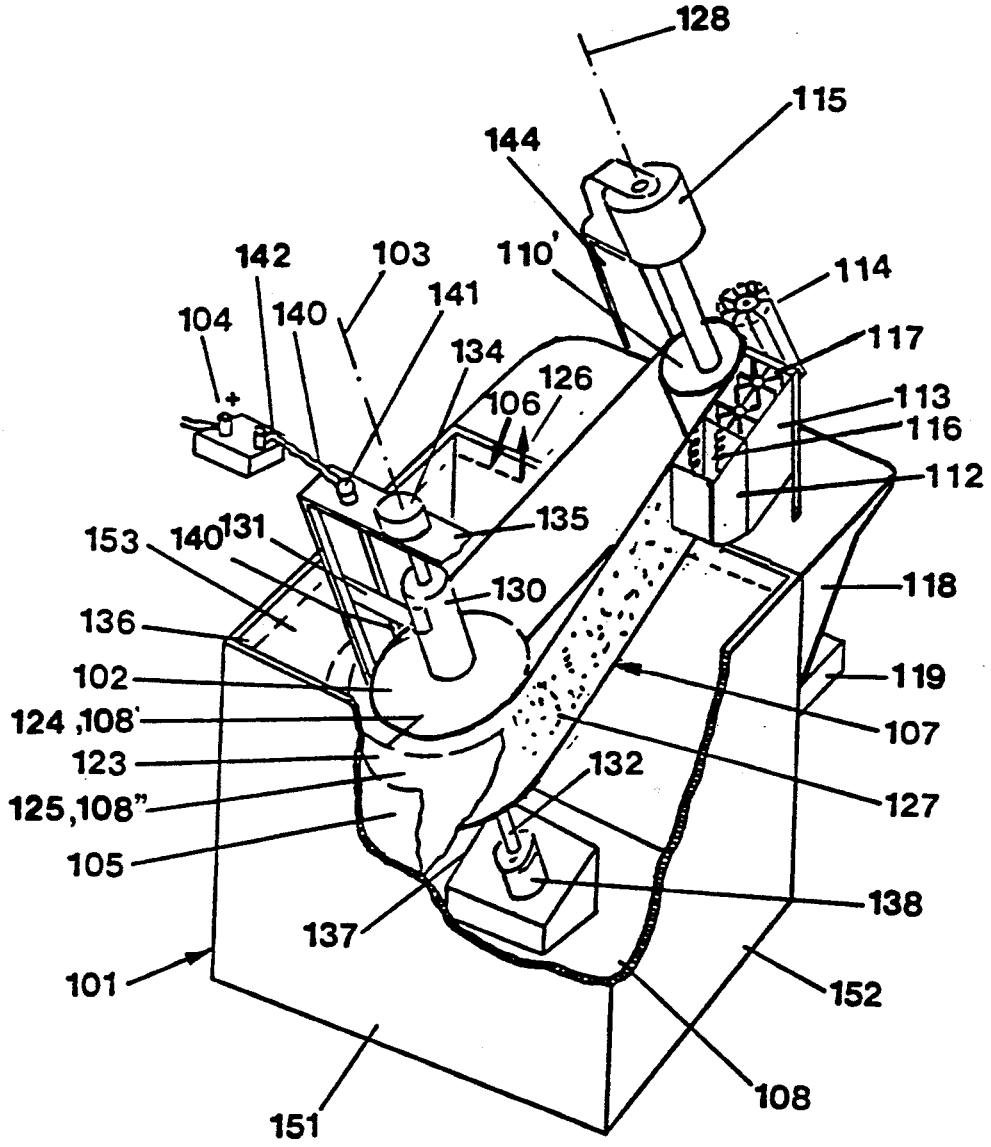
FIG. 4 is a perspective view of a preferred embodiment with the second roller smaller than the first.

The flexible band 107 surrounds the first roller 102, which serves as a cathode drum, preferably covering an area of approximately 0.6 times of its circumference. FIG. 4 depicts one form of apparatus, wherein the second roller 110' is smaller than the first roller 102, which makes this coverage possible. Alternatively, a follower roller could be used with the embodiment of FIG. 1 to alter the path of the band and increase the cathode coverage. This, of course, increases the deposition on the band. Outside the electrolyte solution, the band 107, driven by the second roller 110, passes the different working stations including the drier 112, the scraper 113 and the rinsing device 114. Roller 110 is driven by a diagrammatically represented electromotor 115 (optionally via a gear mechanism). Axis 128 of the second roller 110 runs parallel to axis 103 of the cathode drum. In its upper and lower bearing, the second roller 110 is held by a holder 144 which has largely the same design as the support and bearing of the first roller. The axle of roller 110 is supported by means of a spring arrangement keeping the flexible band 107 tight at all times and moving it. Moreover, it is possible that roller 102, serving as a cathode drum, be equipped with a cooler so as to obtain a high current density on band 107 passing around the cathode.

Moreover, a separating device 123, e.g. an ion exchange membrane, can be used to partition the electrolyte chamber 143 of trough 101 in a first catholyte chamber 124 facing the first roller 102 and an anolyte chamber 125 located on the other side of the separating device 123. The solution is then divided in a catholyte 108' and an anolyte 108''. Depending on the application requirements, it is of course also at any time possible to omit the separating device 123 and to provide a common electrolyte chamber 143 with electrolyte solution 108 or to use a diaphragm as a separating device instead of an ion exchange membrane. The separating device 123 as well as the anode are, for clarity's sake, represented only in a cut-away view. A further view showing a separator in an electrolyte bath is shown in U.S. application Ser. No. 07/576,367 (abandoned), incorporated herein by reference.

At a current density of 6500 A/m$^2$, the band speed is approximately 0.84 m/min. It is also possible to have a band speed ranging between 0.3 m/min and 1.44 m/min. A higher speed must be compensated by a greater current density. The intended maximum current density is 10,000 A/m$^2$.

At least 50% of the cathode drum 102 is immersed in the electrolyte or catholyte, i.e. at least 50% of the drum circumference is below the electrolyte level 106. The temperature of the electrolyte solution ranges between 20° and 100° C.

The temperature in the drier 112 is below the threshold temperature of the band in order to avoid diffusion between the deposited metal and the band.

Gases that may form can escape through the open top of trough 101. When the top of the trough is closed, the upper area of this trough has additional openings for the outlet or the removal of gas forming during the process. These openings, however, are not represented here.

During operation, the flexible band 107, after emerging from the rinsing device 114 is, via driving roller 110, supplied to cathode drum 102 and immersed in the solution 108. The band always contacts the first roller 102 as the cathode drum. During travel of the band, metal is deposited from the solution onto the immersed part of band 107 which is in contact with roller 102. After passing solution 108, the deposited metal emerges again from the bath on the other side of roller 102 which serves as cathode drum. Material 127 consisting of deposited metal and liquid electrolyte particles is symbolically indicated on band 107 by dots. Subsequently, the flexible band 107 is supplied to drier 112 where the deposited material is dried by thermal radiation from coil heaters 116. Then, for the purpose of mechanical separation by means of brushes and scrapers, it is fed to the subsequent scraper 113. The electrolyte-containing metal scraped off by the brushes and scrapers is removed from the band and freely drops into a funnel-like collector 118. The metal is basically conglomerate of powder and adhering bits of deposited material. In order to improve material flow, the apparatus can be equipped with a vibrator. Then, in separating device 119, the electrolyte-containing metal is separated from the remaining electrolyte particles by pressing and filtering to prevent a resuspension of previously deposited material. Subsequently, the band passes rinsing device 114 where rotating scratching brushes 120 clean the band 107 from all remaining precipitation products so that it can be supplied again to cathode drum 102 in trough 101.

Figure 2:
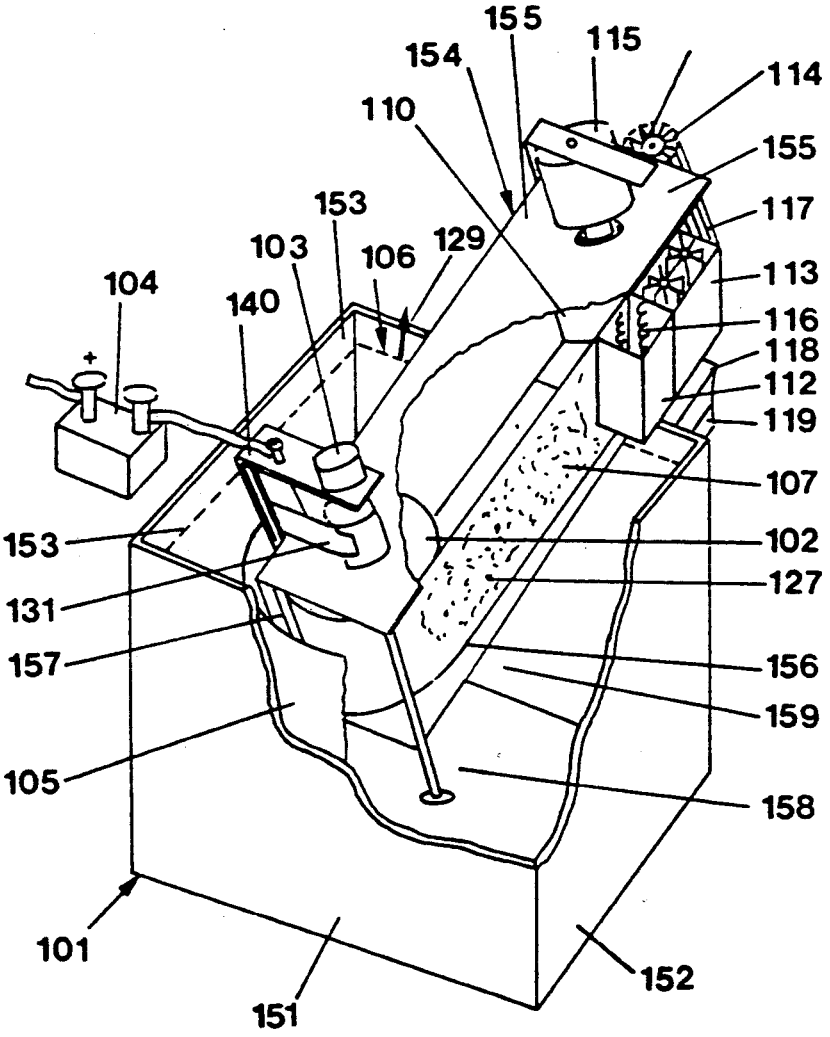
FIG. 2 shows an apparatus similar to the one in FIG. 1 where the electrode arrangement is accommodated in a compact rack.

Function and design of the arrangement of FIG. 2 correspond to the apparatus described in FIG. 1. The two rollers 102 and 110 are rotatably supported on a holder 154. The first roller 102 serving as a cathode drum is again connected to a current collector 131 to make contact with the negative pole of the voltage source 104 whereas the opposite second roller 110 is connected to a driving device 115. The flexible band 107 is tightened between the two rollers by means of springs and serves as a cathodic precipitation surface. On its rear side, it electrically contacts roller 102, the cathode drum. Top plate 155 of holder 154 is partly represented in a cut-away view to illustrate the course taken by the flexible band 107. Drier 112, scraper 113 and rinsing device 114 are mechanically firmly joined to holder 154. This also applies to the funnel-like collector 118 and the separating device 119. Holder 154 rests on spacers 157 in a prescribed position on the bottom of trough 101 with the bottom plate 156 being supported by the top edge of the rear trough wall 159. The apparatus according to FIG. 2, as compared to the apparatus of FIG. 1, which has the same function, has the advantage of being more compact and the electrode arrangement and other individual components, e.g. the flexible band or contact elements, can be more readily replaced. Holder 154 is easy to separate from trough 101.

In this embodiment, it is also possible to have the first roller 102, serving as a cathode drum, to be supported on either one side or on both of its sides.

In FIG. 3, the first roller 102 immerses completely into solution 108 so that the upper edge of the cathode drum is below the liquid level 106. Roller 102 with its axis 103 is at an angle $\alpha$ of 45° with respect to surface normal line 128 which extends over the liquid level 106. Roller 102 with its bottom hub 132 is guided in bearing 138 and with its upper hub 130 in bearing 134. Both bearings are connected to each other by holder 135 which in turn is firmly fixed to pedestal 137. The angle of inclination of 45° allows for a relatively small volume in trough 101. The trough is fully sealed except the upper side of the trough, inlet opening 121 and outlet opening 122. Power is supplied to the cathode drum via current collector 131 which is symbolically represented in this drawing. After emerging from the bath, the continuous band 107 moves past the upper edge of trough 101 in direction toward scraper 113 which removes galvanically deposited metal from the flexible band 107 by means of rotating brushes 117. In order to operate most efficiently, a drier 112 is disposed upstream of scraper 113 which is equipped with symbolically represented coil heaters 116 to thermally dry the deposited material.

The electrolyte-containing material, which had been removed from the band by the brushes and scrapers, freely drops into the funnel-like collector 118 and is then fed to a separating device 119. The metal is basically a conglomerate of powder and adhering bits of deposit. Subsequently, the band 107 passes the also symbolically represented rinsing device 114 where the band 107 is cleaned from all remaining deposit by means of rotating brushes 120. It can then be fed again to trough 101. For this purpose, provision is made for fan 145, symbolically represented, which is connected to a holder 144. For the purpose of cleaning, nozzle 146 of this fan directs the gas flow directly onto the rinsing device 114. It is, however, also possible to employ a liquid flow instead of a gas flow. Longitudinal columns 147, 148 support holder 144 as well as drier 144 and scraper 113 on a support 149 firmly joined to the trough. Operation and design otherwise conform with the apparatus explained in FIG. 1. It is of course also possible to provide an ion exchange membrane between anode 105 and the first roller 102, the cathode drum, so that an anolyte and catholyte chamber can form.

A zinc sulfate solution, for example, can be supplied to the trough 101 as an electrolyte solution whereas the deposited metal essentially consists of zinc. It is of course also possible to use the apparatus of the invention for the electrolytic extraction of other metals, for example heavy or noble metals, from other alkaline or acidic solutions containing metal ions.

I claim:

1. Apparatus for the continuous extraction of metals from a metal ion solution 108 in which an anode 105 and a cathode, both electrically connected to a power supply 104, immerse, wherein the cathode comprises a continuous flexible band 107 partly immersed in the solution and passing through this solution, the flexible band 107 being metallic on at least the part of its surface where metal is deposited in the solution, and where a scraper 113 for the deposited metal is disposed outside the solution and where the band 107 is controlled by means of rollers having axes 103, 128 which together with a surface normal line 129 of the liquid level of the solution enclose an angle $\alpha$ ranging between 20° and 70°, wherein said rollers comprise a first roller 102, as a cathode drum, having a bottom hub 132 and an electrically conductive surface area at least partly immersed in the solution and a second roller 110, as a guiding roller 108, disposed outside the solution, wherein the band has an electrically conductive surface facing the first roller 102.

2. Apparatus in accordance with claim 1, characterized in that a rinsing device 114 for the deposited metal is, in moving direction of the band, disposed after the scraper 113.

3. Apparatus in accordance with claim 1, characterized in that the surface area of the first roller 102, as a cathode drum, is completely surrounded by solution 108.

4. Apparatus in accordance with claim 1, characterized in that a current collector 131 connects the hub 130 of the roller 102 protruding from solution 108 to the negative pole of the power supply 104.

5. Apparatus in accordance with claim 4, characterized in that the first roller is on only one of its sides supported by the hub 130 which protrudes from the solution.

6. Apparatus in accordance with claim 1, characterized in that a second roller 110 disposed outside the solution is provided to drive the band, this second roller 110 being connected to a driving mechanism.

7. Apparatus in accordance with claim 1, characterized in that in moving direction of the band, a drier 112 is provided before the scraper.

8. Apparatus in accordance with claim 7, characterized in that the drier 112 has coiled heaters 116 for the emission of thermal radiation.

9. Apparatus in accordance with claim 1, characterized in that the scraper 113 has rotating brushes 117 whose axes of rotation run parallel to the plane of flexible band 107 passing the scraper.

10. Apparatus in accordance with claim 9, characterized in that a collector 118 for the deposited electrolyte-containing metal is disposed underneath the scraper 113 and followed by a separating device 119.

* * * * *